73-151.5 SR
1-13-76 OR 3,931,735

United States Patent [19]

Guigmard

[11] 3,931,735

[45] Jan. 13, 1976

[54] METHODS AND APPARATUS FOR MEASURING THE RATE OF PENETRATION IN WELL DRILLING FROM FLOATING PLATFORMS

[75] Inventor: Jean Hubert Guigmard, Sainte Mesme, France

[73] Assignee: Schlumberger Technology Corporation, New York, N.Y.

[22] Filed: Dec. 9, 1974

[21] Appl. No.: 530,886

[30] Foreign Application Priority Data

Jan. 23, 1974 France ..... 74.02180

[52] U.S. Cl. ..... 73/151.5; 175/5

[51] Int. Cl.[2] ..... E21B 47/00

[58] Field of Search..... 73/151.5; 33/125 B; 175/5

[56] References Cited

UNITED STATES PATENTS

| | | | |
|---|---|---|---|
| 3,853,004 | 12/1974 | Weslake et al. | 73/151.5 |
| 3,881,695 | 5/1975 | Joabert | 73/151.5 X |

*Primary Examiner*—Jerry W. Myracle
*Attorney, Agent, or Firm*—Ernest R. Archambeau, Jr.; William R. Sherman; Stewart F. Moore

[57] ABSTRACT

New and improved methods and apparatus exemplifying the present invention are disclosed herein for measuring the changes in total elongation of a drill string due to variations in the tensional forces acting thereon during a typical well drilling operation on a floating platform, measuring the changes in the total length of the drill string as it is moved into and out of the borehole from the platform, and measuring the changes in the position of the platform in relation to the upper end of the drill string which are caused by wave motion. Thereafter, these measurments are uniquely combined for producing an output signal which is representative of the changes in the borehole depth. The combined measurements are also converted for producing another output signal which is representative of the actual rate of penetration of a drill bit coupled to the drill string.

22 Claims, 4 Drawing Figures

METHODS AND APPARATUS FOR MEASURING THE RATE OF PENETRATION IN WELL DRILLING FROM FLOATING PLATFORMS

As described in U.S. Pat. No. 3,777,560, it is of considerable importance to know the actual rate at which the drill bit is penetrating earth formations during a typical drilling operation. However, as discussed there, prior proposals utilizing surface measurements for determining the rate of penetration of the drill bit have been largely unsatisfactory since the drill string is constantly changing in length during the course of a typical drilling operation. Thus, the unique system disclosed in that patent has been found to be quite successful in providing reliable measurements of both depth and the actual rate of drill bit penetration since that system accurately accounts for the elongation and contraction of the drill string.

It will, of course, be recognized that the new and improved methods and apparatus described in the aforementioned patent are specifically limited to drilling operations on land-based drilling rigs or stationary drilling platforms. Thus, where a drilling operation is being conducted from either a drilling ship or else a semi-submersible or floating platform, the measurements provided by those new and improved methods and apparatus could not properly account for the rise and fall of the drilling equipment and platform caused by wave movements or tidal action.

Accordingly, it is an object of the present invention to provide new and improved methods for readily determining from surface measurements the true depth and actual rate of penetration of a drill bit while drilling a borehole from a floating drilling platform.

It is a further object of the present invention to provide new and improved apparatus for measuring the instantaneous drilling rate of a borehole after correcting for movements of the drill string which are caused by wave or tidal action on a floating drilling platform.

These and other objects of the present invention are attained by providing new and improved methods and apparatus for measuring the changes in the elongation of a drill string in a borehole and suspended from a floating platform; measuring the incremental changes in the length of the drill string in the borehole; measuring the changes in the vertical position of the platform in relation to the earth's surface; and, after correlating these measurements, converting them for deriving information which is representative of the true depth and actual rate of penetration of the drill bit during a drilling operation from the floating platform.

The novel features of the present invention are set forth with particularity in the appended claims. The invention, together with further objects and advantages thereof, may be best understood by way of the following description of exemplary apparatus and methods employing the principles of the invention as illustrated in the accompanying drawings, in which:

Figure 1:
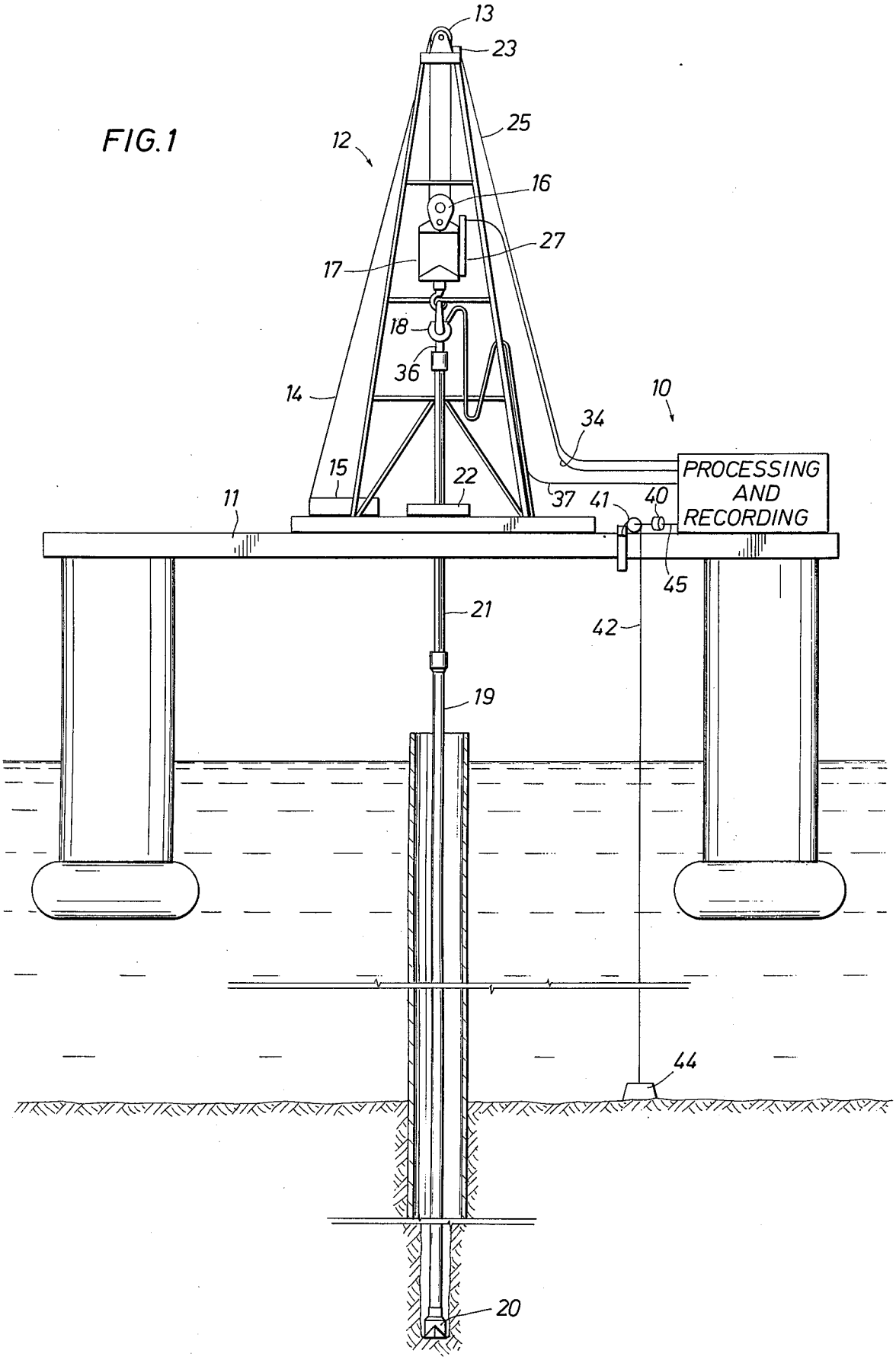
FIG. 1 shows a typical floating drilling rig including new and improved instrumentation arranged in accordance with the invention.

Referring to FIG. 1, new and improved instrumentation 10 of the present invention is schematically depicted on a typical drilling vessel or floating platform 11 which is in position for drilling into sub-sea formations. As is customary, a rotary drilling rig 12 arranged on the platform 11 includes a crown block 13 over which runs a hoisting cable 14 driven by a draw works 15 adapted for operatively controlling the upward and downward movements of a traveling block 16 carried by the cable. The traveling block 16 carries a typical heave or wave-motion compensator 17 such as shown, for example, on pages 4,539–42 of the 1972–73 Composite Catalog of Oil Field Equipment & Services. The compensator 17 is, in turn, coupled to a conventional rotary swivel 18 which supports a drill string 19 comprised of a number of tandemly-coupled joints of drill pipe and drill collars. As is customary, the drill string 19 carries a drill bit 20 at its lower end and is dependently supported at its upper end by a kelly joint 21 which is rotatively driven by a selectively-powered rotary table 22 on the drilling rig 12.

It will, of course, be appreciated that the downward movements of the drill bit 20 which will result in further excavation of the borehole being drilled are primarily accomplished by lowering the traveling block 16. Accordingly, in keeping with the objects of the present invention, the new and improved instrumentation 10 is cooperatively arranged for measuring at the surface the successive changes in length of the drill string 19 which occur upon operation of the draw works 15 and producing a series of first electrical signals which are representative of the direction of travel as well as the incremental distances traveled by the surface end of the drill string. Although these measurements can, of course, be determined in different ways without departing from the scope of the present invention, the preferred embodiment of the new and improved instrumentation 10 depicted in FIG. 2 includes displacement-responsive means such as an optical coding device 23 (such as disclosed at "24" in the aforementioned U.S. Pat. No. 3,777,560) which is operatively associated with one of the pulleys in the crown block 13 for providing these first electrical signals. As described in that patent, the optical coder 23 includes a rotatable slotted disc which is cooperatively arranged to periodically interrupt a pair of light beams directed toward a pair of photodiodes for simultaneously producing first and second trains of phase-shifted electrical pulses at a frequency or pulse rate representative of the rotational speed of the slotted disc. In this manner, by operatively coupling the optical coder 23 to the crown block 13 as by a rotatably-driven shaft 24, the pulse rate of these output pulses will be representative of rotational speed of the crown block and the phase relationship between the two pulse trains will be indicative of its direction of rotation.

The outputs of the optical coder 23 are linked via a cable 25 to a typical directional logic circuit 26 which may include a shaping input circuit and is cooperatively arranged for generating a series of positive pulses, $+V_s$, when the crown block 13 rotates in on selected direction and a series of negative pulses, $-V_s$, when the crown block rotates in the other direction. Thus, as a matter of choice, the logic circuit 26 is arranged so that a downward movement of the drill string 19 occurring upon lowering of the traveling block 16 will produce a corresponding series of positive pulses, $+V_s$, and an upward movement of the string upon raising of the traveling block will conversely produce a corresponding series of negative pulses, $-V_s$, with each pulse being representative of a selected increment of length. It will be seen, therefore, that the signals, $+V_s$, and $-V_s$, are alternative output signals from the logic circuit 26, with the number of these pulses being representative of the distance traveled by the upper portion of the drill string 19 upon movements of the traveling block 16 and that the frequency or pulse rate of these pulses will be respectively proportional to the rate of travel or vertical displacement of the upper end of the drill string caused by operation of the draw works 15. The polarity of these pulses will, of course, indicate the direction of travel.

Those skilled in the art will, of course, appreciate that when the heave compensator 17 is in operation, the movements of the crown block 13 and the traveling block 16 are measured by the displacement-responsive transducer means 23 will not always fully represent the total displacement of the upper end of the drill string 19. Accordingly, in keeping with the objects of the present invention, relative longitudinal movements between the traveling block 16 and the swivel 17 are also measured by arranging displacement-responsive transducer means, as at 27, on the heave compensator 17 for providing a series of second electrical signals representative of the extent and direction of the independent movements of the drill string 19 which are caused by operation of the heave compensator.

Figure 3:
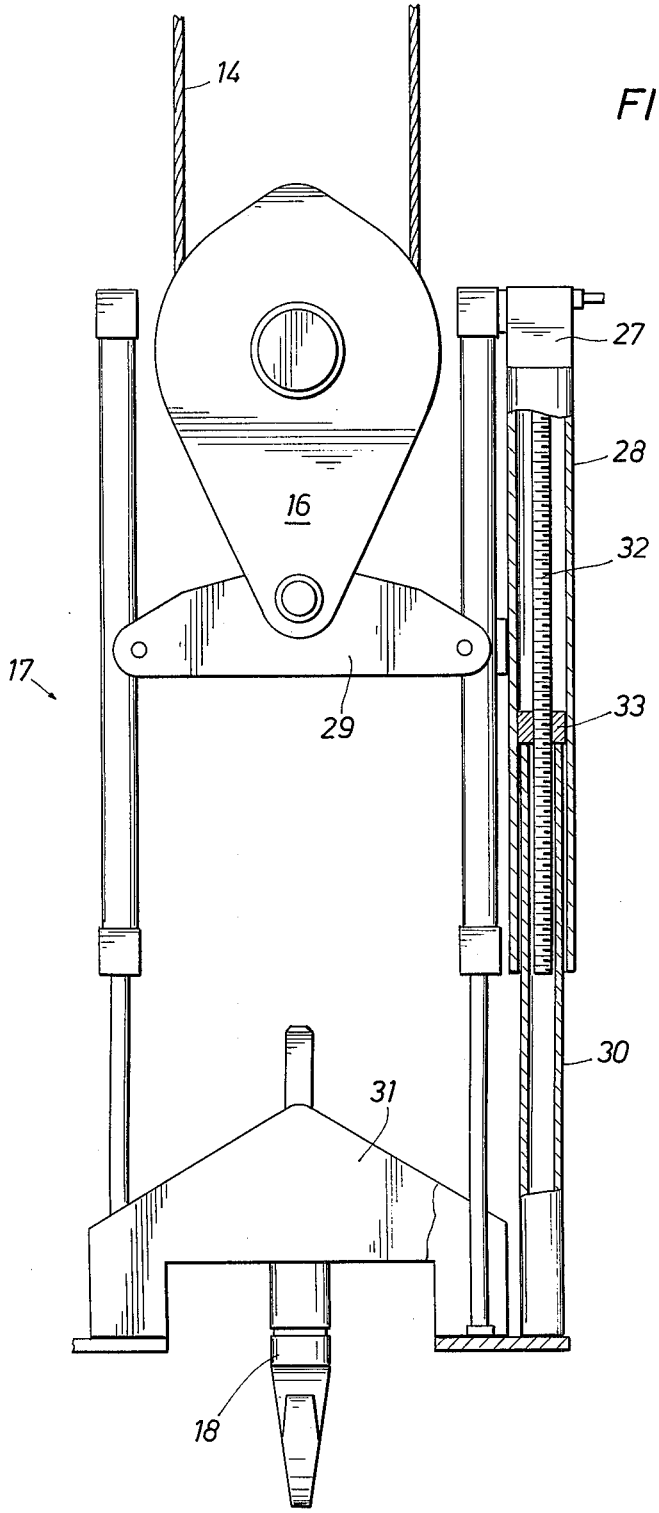
FIGS. 3 and 4 depict various portions of the new and improved instrumentation shown in FIG. 2.

Although other types of position-monitoring devices could be used within the spirit of the present invention, the transducer means 27 preferably include an optical coding device similar or identical to the optical coder 23 and which is cooperatively arranged on the heave compensator 17 as best seen in FIG. 3. Thus, as seen there, the coder 27 is mounted in an inverted position on top of an upright elongated tubular guard 28 which is secured to one end of the upper frame 29 of the compensator 17 and coaxially disposed around a smaller tube 30 secured to the lower frame 31. The rotatable shaft of the coder 27 is coupled to an elongated threaded shaft 32 that is coaxially disposed in the tubular guard 28 and carries a threaded nut 33 which is fixed to the smaller tube 30 for operatively rotating the threaded shaft 32 in accordance with the upward and downward relative movements between the upper and lower frames 29 and 31 of the heave compensator 17 during the operation of the drilling rig 12.

Referring again to FIG. 2, the outputs of the optical coder 27 are coupled by an electrical cable 34 to a directional logic circuit 35 which is similar or identical to the logic circuit 26 and is cooperatively arranged for generating a series of positive pulses, $+V_h$, when the compensator frames 29 and 31 move apart and for generating a series of negative pulses, $-V_h$, when the heave compensator 17 is contracted. Each of these alternative pulses, $+V_h$ and $-V_h$, are selected to be representative of a selected increment of length corresponding to that chosen for the pulses, $+V_s$ and $-V_s$, from the other logic circuit 26. Thus, as in the case of the logic circuit 26, the frequency or pulse rate of these second signals, $+V_h$ and $-V_h$, produced by the logic circuit 35 will be representative of the linear displacements of the upper end of the drill string 19 caused by operation of the heave compensator 17 and the polarity of these pulses will be indicative of the direction of these displacements.

As discussed at length in the aforementioned U.S. Pat. No. 3,777,560, the drill string 19 is constantly subjected to significant tensional forces which continuously vary during the course of a drilling operation. Thus, since the drill string 19 is typically of considerable length, the accurate determination of the depth of the borehole and the actual rate of penetration of the drill bit 20 will also require that the variations in the overall length of the drill string caused by its elongation and contraction under these changing tensional forces be taken into account during the practice of the present invention.

Figure 2:
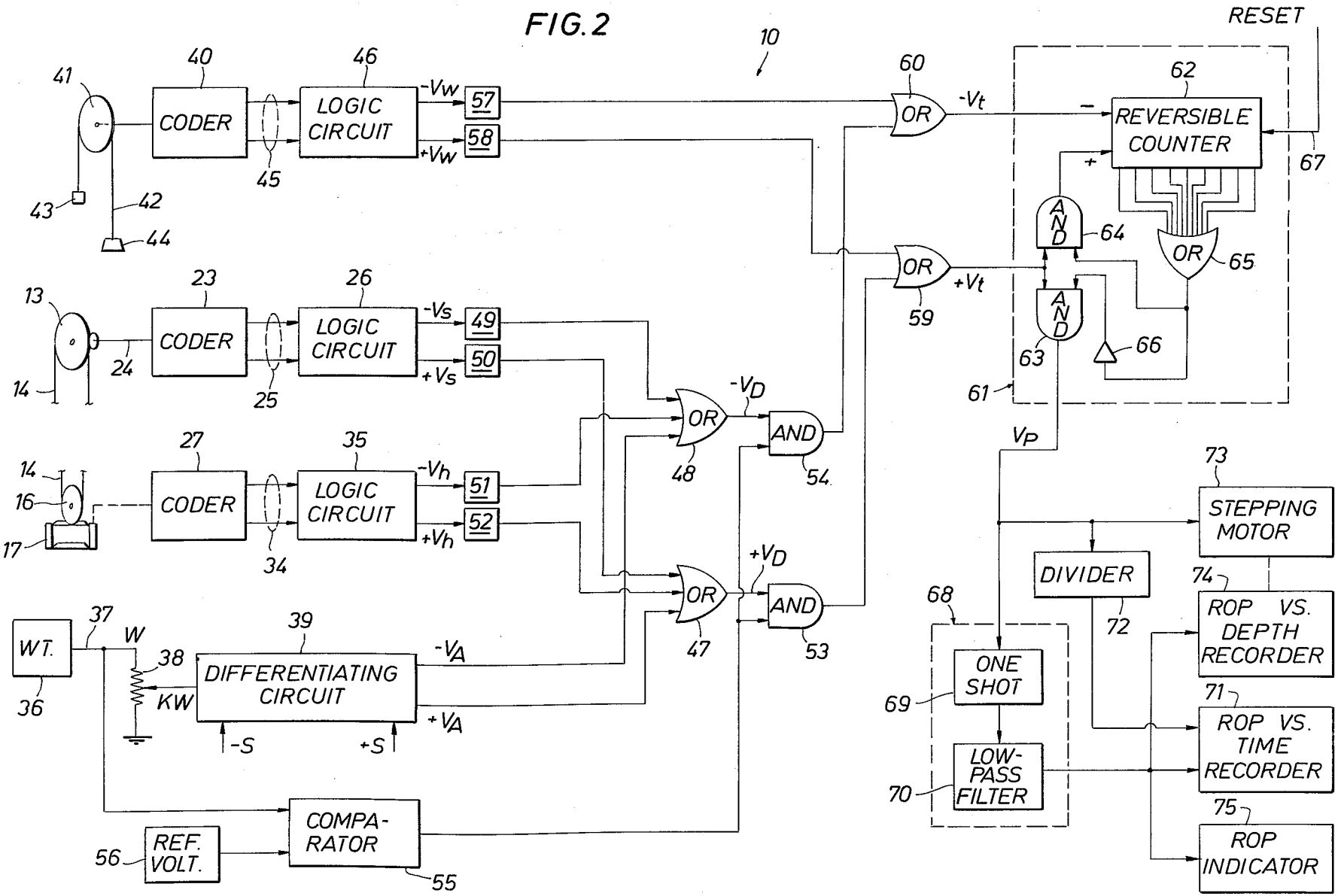
FIG. 2 is a block diagram of a preferred embodiment of the measuring instrumentation of the present invention which is especially adapted for practicing the methods of the invention.

Accordingly, in the preferred embodiment of the new and improved instrumentation 10 shown in FIG. 2, elongation-responsive means such as a force-responsive transducer 36 coupled between the swivel 18 and the kelly 21 are operatively arranged for successively producing a series of third electrical signals which are representative of incremental elongational changes in the length of the drill string 19. As fully disclosed at "27" in U.S. Pat. No. 3,777,560, the force-responsive transducer 36 preferably includes a thermally-compensated strain gage bridge connected to the input of an amplifier (neither of which are shown here) for accurately measuring small variations in the tensional forces acting on the drill string 19. The output signal, W, from the force-responsive transducer 36 is coupled by a cable 37 to a weighting circuit comprised, for example, of a variable resistor 38 for multiplying the output signal, W, of the transducer by a selected coefficient, K, which is a function of the elasticity of the drill pipe in the drill string 19.

By virtue of Hooke's Law, it will be recognized that the coefficient, K, is determined by dividing the total length of the several joints of drill pipe in the drill string 19 by the product of the transverse cross-sectional metal area and the modulus of elasticity of this particular type of drill pipe. Thus, by multiplying the force, W, sensed by the transducer 36 by the coefficient, K, the resulting signal, KW, will be representative of the changes in the elongation of the drill string 19 which are produced by variations in the tension force, W. It will, of course, be realized that should different types or grades of drill pipe be coupled into the drill string 19, the coefficient, K, can be determined by simply adding the individual coefficients calculated for each type of drill pipe included in the string so as to provide an overall or a composite value for the coefficient, K, for accurately producing the signal, KW. It should also be noted that since only a minor portion of the overall length of the drill collars in the drill string 19 will be in tension and since these drill collars are also relatively stiff in relation to the drill pipe in the string, the coefficient, K, may ordinarily be safely determined without considering the drill collars.

The potentiometer 38 is, of course, selected to provide the maximum anticipated value of the coefficient, K, when the movable contract is at the ungrounded end of the resistance element. Thus, for lesser values of K, the movable contact will be selectively set at an appropriate intermediate position on the resistance element of the potentiometer 38. Although the potentiometer 38 theoretically requires repositioning each time an additional joint of drill pipe is coupled into the string 19, it has been found that, as a practical matter, sufficientlyaccurate measurements are obtained in the practice of the present invention by readjusting the potentiometer at only infrequent interval. For example, when the drill bit 20 is drilling in hard formations, adjustments of the potentiometer 38 may be made only once or twice a day since drilling speeds are typically so low in such formations that the overall length of the drill string 19 is not significantly increased in such a time interval.

The output of the potentiometer 38 is coupled to the input of a quantized differentiating circuit 39 (such as shown in FIG. 3 in U.S. Pat. No. 3,777,560) for producing a series of output signals which are proportional to the incremental changes in the overall length of the drill string 19 caused by its elongation and contraction. As fully described in the aforementioned patent, this is accomplished by comparing the signals, KW, with two comparison signals, +S and −S, of opposite polarity and respectively having a selected magnitude of an equal value. The magnitude of these comparison signals is selected so that the differentiating circuit 39 will produce alternative series of output pulses, $+V_a$ or $-V_a$, having a pulse rate or frequency which is representative of the rate of change in elongation of the drill string, with each pulse being representative of a selected incremental unit of change in length of the drill string 19. In this manner, the positive output pulses, $+V_a$, from the differentiating circuit 39 will be successively produced in response to incremental elongations of the drill string 19 and the negative output pulses, $+V_a$, will be successively produced in response to incremental contractions of the drill string.

Accordingly, as described to this point, it will be appreciated that the new and improved instrumentation 10 of the present invention includes displacement-responsive means (as exemplified by the transducers 23 and 27 and their respective logic circuits 26 and 35) which are operatively arranged for independently producing first and second series of output pulses (either $+V_s$ or $-V_s$ or $+V_h$ or $-V_h$) which are respectively related to a selected incremental length of the drill string 19 which has been moved either downwardly or upwardly in relation to the platform 11. The frequency or pulse rate of the first and second series of pulses, $+V_s$ and $-V_s$ as well as $+V_h$ and $-V_h$, will be proportional to the rate of travel of the drill string 19 and the polarity of these pulses will indicate the direction of the movement. Moreover, the elongation-responsive means of the instrumentation 10 (as exemplified by the circuit 39) are adapted for producing third series of output pulses, either $+V_a$ or $-V_a$, which are respectively related to incremental elongational changes in the overall length of the drill string 19. The frequency or pulse rate of these third pulses will be proportional to the rate of the change of the overall length of the drill string 19; and their polarity will indicate whether the overall length of the string has been increased or decreased.

It will be recognized that the drill bit 20 will be penetrating an earth formation only upon downward movements of the drill bit whether these movements are caused by further elongation of the drill string 19, actual downward movement or displacement of the drill string by operation of the draw works 15, or a movement caused by the heave compensator 17, or any combination of these three movements. Moreover, it should be appreciated that the actual displacement movements of the drill string 19 are independent of the elongational changes of the drill string. For example, as previously explained, the usual drilling practice is to periodically retain the upper end of the drill string 19 at a selected position in relation to the platform 11 and allow it to further elongate as the drill bit 20 continues to deepen the borehole. Conversely, as the drill string 19 is periodically lowered to increase the weight imposed on the drill bit 20, the drill string will be contracted as the tensional forces acting thereon are correspondingly reduced. In this latter situation, it will be recognized that the downward travel of the drill string 19 will be partially offset by the attendant relaxation of the drill string so that during this time the actual rate of penetration of the drill bit 20 will be correspondingly less than the instant rate of downward travel of the surface end of the drill string. Similarly, the operation of the heave, compensator 17 will be independently effective for changing the position of the upper end of the drill string 19 in relation to the platform 11. For instance, in addition to the typically minute changes in position caused by the usual automatic operation of the have compensator 17, those skilled in the art will also recognize that it is not unusual for the heave compensator to be deliberately controlled manually for lowering the upper end of the drill string 19 as far as is permitted by the available stroke of the compensator pistons. In any case, various independent movements of the upper end of the drill string 19 attributed to the operation of the heave compensator 17 will also be accurately measured by the transducer means 27.

It will, of course, be appreciated that since the output measurements provided by the new and improved instrumentation 10 as disclosed so far are all based on some arbitrary reference point such as the floor of the platform 11, appropriate corrections must also be made for the wave-induced motion of the platform.

Figure 4:
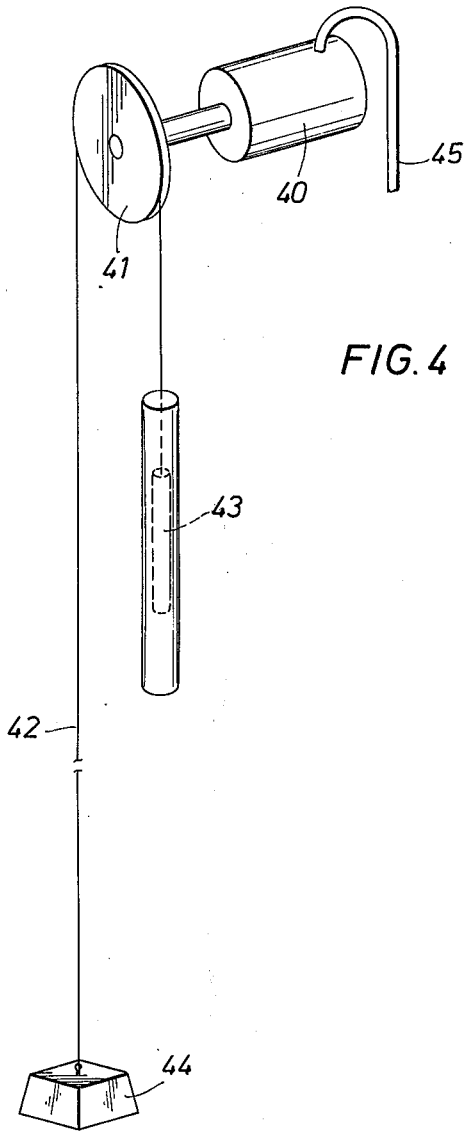

Accordingly, as schematically depicted in FIGS. 1 and 4, the new and improved instrumentation 10 further includes wavemotion transducer means such as a third optical coder 40 which is mounted on the platform 11 and cooperatively arranged for providing a series of fourth electrical signals which are representative of the wave or tidal movements of the platform. Although other arrangements of a similar nature can, of course, be employed without departing from the principles of the present invention, it is preferred to couple the driving shaft of the wave-motion coder 40 to a rotatable pulley 41 which is mounted at a convenient location on the platform 11. As illustrated, the pulley 41 carries a looped wire rope or cable 42 which has one end connected to a counterweight 43 and its other end secured to an anchor or massive weight 44 that is stationed on the sea floor below the platform 11. In this manner, it will be recognized that the upward and downward movements of the floating platform 11 will be responsively accompanied by a corresponding back-and-forth movement of the pulley 41 at a speed representative of that of the wave action and through an arc of travel proportional to the height of the waves.

The outputs of the optical coder 40 are coupled by an electrical cable 45 to a directional logic circuit 46 which, as with the circuits 26 and 35, is cooperatively arranged for alternatively producing a series of output pulses, $+V_w$, when the platform 11 is moved downwardly by wave or tidal action and a series of output pulses, $-V_w$, when the platform moves upwardly. Similarly, these alternative pulses, $+V_w$ and $-V_w$, are selected to correspond to the same incremental distance as previously chosen for the outputs of the several transducer circuits 26, 35 and 39; and the frequency and polarity of these pulses will also respectively indicate the vertical distance traveled by the platform 11 and the direction in which it is moving.

In keeping with the objects of the present invention, therefore, the new and improved instrumentation 10 depicted in FIG. 2 is further arranged for operatively combining all of the aforementioned four signals and then processing the combined signals as required for providing accurate indications at the surface which are representative of the actual rate of penetration of the drill bit 20 as well as its actual depth. To best accomplish this, the positive signal outputs of the displacement-responsive means 23 and 27 as well as the elongation-responsive means 36 are respectively coupled to the inputs of an OR gate 47 for producing a series of positive output pulses, $+V_d$, in response to the generation of either positive displacement pulses, $+V_s$ or $+V_h$, or positive elongation pulses, $+V_a$, or any two or all three types of these positive pulses. Similarly, the negative signal outputs of the displacement-responsive means 23 and 27 as well as of the elongation-responsive means 36 are respectively coupled to the inputs of an OR gate 48 for producing a corresponding series of negative output pulses, $-V_d$, in response to the generation of any one, two or three types of the negative pulses $-V_s$, $-V_h$ and $-V_a$. Although the wave-motion transducer means 40 could be similarly coupled to the OR gates 47 and 48, this is preferably not done for reasons which will subsequently be explained.

To prevent the displacement-responsive pulses, $V_s$ or $V_h$, from being masked by the elongation-responsive pulses, $V_a$, the circuits 26 and 35 supplying these pulses to the gates 47 and 48 are respectively designed to generate very short pulses thereby reducing the probability that two of these pulses will appear simultaneously at the inputs of the gates 47 and 48. Thus, in the preferred embodiment of the new and improved instrumentation 10, shaping circuits such as monostable multivibrators or oneshots 49–52 are coupled to the outputs of the logic circuits 26 and 35 to minimize the duration of the pulses, $V_s$ and $V_h$. It will also be noted that instead of being alternative signals as are the signals, $+V_s$ and $-V_s$ or $+V_a$ and $-V_a$ or $+V_h$ and $-V_h$, the combined signals, $+V_d$ and $-V_d$, may simultaneously appear at the outputs of the OR gates 47 and 48.

As previously mentioned, the actual rate of penetration of the drill bit 20 is decreased by contractions of the drill string 19 in response to decreases of the tensional forces acting thereon as well as by any upward movements of the drill string. Conversely, the actual rate of penetration of the drill bit 20 is increased both by downward movements as well as by further elongations of the drill string 19. It will be recognized, however, that when another joint of pipe is added to the drill string 19, the kelly 21 is temporarily disconnected and the drill string is suspended by slips placed in the rotary table 22. Various extraneous movements of the traveling block 16 are, of course, then required for adding another joint of pipe to the drill string 19.

Accordingly, to temporarily discontinue the processing of the output signals from the displacement-responsive means 23 and 27 as well as the elongation-responsive means 36 while the drill string 19 is being lengthened or shortened, the outputs of the OR gates 47 and 48 are respectively coupled to one of the inputs of two AND gates 53 and 54 which, ordinarily, are operatively enabled so that the output signals, $V_d$, will be processed so long as a drilling operation is actually progressing. To control the operation of the two AND gates 53 and 54, a comparator 55 is coupled to the other inputs of the AND gates 53 and 54 and the inputs of the comparator are respectively connected to a reference voltage source 56 and to the output of the load transducer 36. In this manner, when the weight sensed by the elongation-responsive means 36 is less than a predetermined value, the comparator 55 then functions to temporarily inhibit the AND gates 53 and 54. The reference voltage is preferably chosen so that this occurs only when reduced force measurements by the transducer 36 indicate that the drill string 19 has been placed on the slips. When the drill string 19 is again suspended from the traveling block 16, the AND gates 53 and 54 are reenabled by operation of the comparator 55 and, as will subsequently be explained, processing of the output signals, $V_d$, will be resumed. Thus, in the subsequent description of the operation of the new and improved instrumentation 10, it should be assumed that the AND gates 53 and 54 are enabled at all times.

It will, of course, be appreciated that the output signals, $+V_d$ and $-V_d$, are representative only of the movements and the position of the drill bit 20 in relation to the moving platform 11. Accordingly, to establish the actual movements and absolute position of the drill bit 20 in relation to a fixed datum such as the sea bed, the positive and negative outputs of the wave-motion logic circuit 46 are respectively coupled by way of one-shots 57 and 58 to one input of two OR gates 59 and 60 which, in turn, have their other inputs respectively coupled to the outputs of the normally enabled AND gates 53 and 54. It will be appreciated, therefore, that the output signals, $+V_t$ and $-V_t$, from the OR gates 59 and 60 represent the combination of the several incremental measurements respectively provided by the force-responsive transducer 36 and the displacement-responsive transducer means 23 and 27 as well as the wave-motion transducer means 40.

Since only downward displacements or elongations of the drill string 19 will actually result in further deepening of the borehole being drilled by the drilling rig 12, it will be appreciated that the output signals, $V_t$, from the OR gates 59 and 60 must be appropriately processed so as to provide indications of further penetration of the drill bit 20. Accordingly, the outputs of the OR gates 59 and 60 are respectively coupled to the inputs of signal-processing means 61 cooperatively arranged for providing an output signal, $V_p$, only when the drill bit 20 is on the bottom of the borehole and the drill string is actually moving downwardly to deepen the borehole. In the preferred embodiment of the signal-processing means 61, this is accomplished by supplying the output signals, $-V_t$, to the subtraction input of a typical reversible counter 62 (such as shown at "46" in U.S. Pat. No. 3,777,560). The other output signals, $+V_t$, are, in turn, supplied to one input of each of two alternatively-enabled AND gates 63 and 64 which are selectively controlled by the counter 62 for producing the output signals, $V_p$, only so long as the counter is in a "0" state.

Accordingly, as illustrated in FIG. 2, the $+V_t$ signals from the OR gate 59 are simultaneously supplied to one input of the AND gate 64 which has its output coupled to the addition input of the counter 62 as well as to one input of the AND gate 63. The output stages of the reversible counter 62 are connected to an OR gate 65 whose output is connected, on the one hand, to the other input of the AND gate 64 and, on the other hand, to an inverter 66. The output of the inverter 66 is connected to the second input of the AND gate 63. Accordingly, when the counter 62 is in a "0" state, the output signal of the OR gate 65 is a zero signal which inhibits the AND gate 64 and, by virtue of the inverter 66, enables the AND gate 63. For all other states of the counter 62, the AND gate 63 is inhibited, the pulses $+V_t$ then being applied to the input of the counter for summation by way of the gate 64.

It will be seen, therefore, that the signal-processing circuit 61 including the counter 62, the operatively-arranged gates 63–65, the inverter 66 are mutually responsive to the displacement signals, $+V_t$ and $-V_t$, for providing the output signals, $V_p$, only when there is a downward advancement of the drill bit 20 during a drilling operation as a result of either an actual downward displacement of the drill string 19 at the surface or an elongation or increase in the overall length of the drill string. On the other hand, the signal-processing circuit 61 is cooperatively arranged so that an actual upward displacement of the drill string 19 will discontinue the production of further output pulses, $V_p$, until the drill bit 20 is again at its previous lowermost depth to continue further excavation of the borehole.

The effects of wave and tidal motion on the platform 11 are also compensated for by the operation of the signal-processing circuit 61. Disregarding this compensatory action for the moment, however, it will be appreciated that each time there is either an incremental upward movement of the drill string 19 at the surface ($-V_s$) or an incremental shortening of the drill string ($-V_a$), the OR gates 48 and 60 will always supply a negative pulse, $-V_t$, directly to the subtraction input of the counter 62. Similarly, each time the OR gates 47 and 59 supply a positive pulse, $+V_t$, representative of either an incremental downward movement or an incremental lengthening of the drill string 19, the OR gate 65 is selectively responsive to the present state of the counter 62 for either directing the positive pulse to the addition input of the counter or for producing a pulse, $V_p$, at the output of the gate 63. For example, assume that with no wave action, the drill bit 20 has been steadily moving downwardly so that the output of the OR gate 65 is a zero signal signifying that the counter 62 is in a "0" state. The OR gate 65 will, therefore, inhibit the AND gate 64 and enable the AND gate 63 so that each positive pulse, $+V_t$, at the input of the signal-processing circuit 61 will simultaneously produce an output pulse, $V_p$, at the output of that circuit. Under this situation, a continuation of positive input pulses, $+V_t$, will produce a corresponding series of output pulses, $V_p$, having the same pulse rate.

A single negative input pulse, $-V_t$, signifying either a shortening of the drill string 19 or an upward movement of the drill string at the surface will, however, be applied to the subtraction input of the counter 62 to immediately produce an output signal from the OR gate 65 which is representative of the counter being in a negative or "non-0" state. The OR gate 65 then inhibits the AND gate 63 to discontinue further production of the output signals, $V_p$, until the counter 62 is again in a "0" state and concurrently enables the AND gate 64 to direct subsequent positive input pulses, $+V_d$, to the adding input of the counter.

It will be appreciated, therefore, that the continuation of negative input pulses, $-V_t$, will maintain this condition of the signal-processing circuit 61 and no output signals, $V_p$, will be produced which is, of course, representative of no advancement of the drill bit 20 and a zero rate of penetration. On the other hand, assume that this situation was in response to either a momentary elevation of the drill string 19 at the surface or a brief reduction in the tension load sensed by the transducer 36 causing the drill string to shorten, once either a downward movement or a lengthening of the drill string occurs to produce a positive input pulses, $+V_t$, this positive pulse will be directed to the counter 62 to place it into a less-negative state. Thus, once the number of positive pulses, $+V_t$, which are subsequently directed by the AND gate 64 to the counter 62 equals the number of negative pulses, $-V_t$, previously stored in the counter, the counter is again placed in a "0" state and the AND gates 64 and 63 are again respectively inhibited and enabled by the resumption of the zero output signal of the OR gate 65. It should be noted that the brief delay inherent with this circuitry will prevent the final positive pulse, $+V_t$, which re-enables the AND gate 63 from producing an extraneous output pulse, $V_p$. However, once the counter 62 is restored to its "0" state, the output pulses, $V_p$, will again be produced by the circuit 61 in response to subsequent input pulses, $+V_t$.

It should be noted also that the counter 62 needs only to have a sufficient number of stages for storing displacement pulses representative of the vertical distance over which the traveling block 16 is capable of moving in relation to the floor of the platform 11 since it is not necessary to totalize movements of the drill string 19 over any greater distance above the bottom of the borehole. A manual reset 67 is, therefore, provided for resetting the counter 62 when drilling is to be resumed such as, for example, after a trip for changing the drill bit 20 or when the new and improved instrumentation system 10 is to be energized.

In addition to the several responses discussed above, it will, of course, be realized that the effects of tidal action on the platform 11 will also be taken into account by the signal-processing circuit 61. However, since tidal action is ordinarily relatively slow and will cause the platform 11 to move in only one direction over a prolonged time, it will be readily appreciated that the resulting signals, $+V_w$ or $-V_w$, will be quickly assimilated by the signal-processing circuit 61 as they periodically produce a corresponding output signal, $+V_t$ or $-V_t$.

Wave action on the platform 11 is, of course, ordinarily at fairly-frequent intervals so that there will be a continuous alternative output of first the $-V_w$ signals and then the $+V_w$ signals which are respectively representative of the upward and downward movements of the platform. It will, however, be recognized that usually these pulses will simply offset one another since the rise of the platform 11 above a given datum such as the sea floor will ordinarily equal the subsequent fall of the platform toward this datum. Thus, over any appreciable length of time, the cummulative total of $+V_w$ signals will equal the cummulative total of $-V_w$ signals.

It should be realized, however, that the signal-processing circuit 61 will still consider any actual downward movements of the drill bit 20 caused by either downward displacement of the drill string 19 ($+V_s$) or elongation of the drill string ($+V_a$) occurring while the counter 62 is in a non-zero state as a result of a series of $-V_w$ pulses. For example, assume that the present wave action on the platform 11 is alternately producing one thousand $+V_w$ pulses and one thousand $-V_w$ pulses. In this situation, if there is no advance of the drill bit 20 during a given time interval, the counter 62 will remain in its non-zero state until all one thousand $+V_w$ pulses have been supplied to its addition input. On the other hand, if there is an actual advancement of the drill bit 20 (as represented, for example, by a series of either one hundred $+V_s$ pulses or one hundred $+V_a$ pulses) during this time interval, the counter 62 will be restored to its zero state proportionally sooner so that the latter portion of the wave action which is producing the last one hundred $+V_w$ pulses will then cause the production of one hundred $V_p$ pulses corresponding accurately to the 100 $+V_s$ pulses or $+V_a$ pulses that had been previously supplied to the addition input of the counter. Thus, the net result will be to produce a $V_p$ signal which accurately reflects the true advancement of the drill bit 20.

A similar response is realized from the transducer means 27 on the heave compensator 17. Any cyclic production of $+V_h$ and $-V_h$ pulses will be treated in a similar fashion by the processing circuitry 61 so that the overall net result will also be to produce a corresponding number of $V_p$ pulses which are representative only of an actual advancement of the drill bit 20. On the other hand, any operation of the heave compensator 17 which actually causes further advancement of the drill bit 20 will, of course, quickly result in the production of a correct number of $V_p$ pulses to accurately reflect the true advancement of the drill bit. Conversely, any net independent upward movement of the drill string 19 by operation of the heave compensator 17 will produce a corresponding number of $-V_h$ pulses which will place the counter 62 in a more-negative state so that there must be a sufficient number of either $+V_s$ pulses or $+V_a$ pulses to restore the counter to its zero state before additional $V_p$ pulses can be produced by the signal-processing circuit 61.

Inasmuch as the frequency or pulse rate of the pulses, $V_p$, is proportional to the actual rate of penetration, the new and improved instrumentation 10 further includes means for converting the frequency of these pulses to an indication or record of the rate of penetration of the drill bit 20 during the course of a drilling operation. In the preferred manner of accomplishing this, the instrumentation 10 includes a frequency-to-voltage converter 68 which is comprised of a monostable or one-shot circuit 69 followed by a low-pass filter 70 designed to cover the anticipated frequency or pulse rate output range of the pulses, $V_p$. It will, of course, be appreciated that the low-pass filter 70 will cooperate to provide an output signal which is the average of the instantaneous drilling speed. Thus, for providing a record of the rate of penetration of the drill bit 20 as a function of time, the output of the frequency-to-voltage converter 68 is coupled to a time recorder 71. To provide a record of total depth as a function of time, the output pulses, $V_p$, are also coupled to the time recorder 71 by means such as a pulse divider 72 for printing a mark on the recording medium each time the drill bit 20 has drilled an incremental depth corresponding to the predetermined distance assigned to each pulse.

It will also be recognized that the summation of the number of output pulses, $V_p$, is also representative of the total depth of the borehole as drilled at that time. Accordingly, to provide visual indications or a continuous record of the rate of penetration versus depth during the course of a drilling operation with the drilling rig 12, the output pulses, $V_p$, are also employed for operating a stepping motor 73 which drives a recorder 74 to which the output of the converter 68 is coupled. If a rate-of-penetration indicator, as at 75, is desired, it can also be coupled to the output of the converter 68 for providing an instantaneous indication at some convenient location on the surface of the present penetration rate of the drill bit 20.

Accordingly, it will be appreciated that the present invention has provided new and improved methods and apparatus for providing surface measurements of the actual rate of penetration of a drilling bit during the course of a drilling operation from a floating platform. As previously described, these new and improved methods and apparatus are uniquely arranged for accurately determining the distance travelled downwardly by the drill string and the increases in its overall length. By combining and then converting the combined measurements, instantaneous indications are provided at the surface which are representative of the true rate of penetration of the drill bit.

While only a particular embodiment of the present invention and one mode of practicing the invention have been shown and described, it is apparent that changes and modifications may be made without departing from this invention in its broader aspects; and, therefore, the aim in the appended claims is to cover all such changes and modifications as fall within the true spirit and scope of this invention.

What is claimed is:

1. A method for determining at least one function representative of the penetration into earth formations of a drill bit suspended from a drill string carried by a floating platform and disposed in a borehole, comprising the steps of:

successively determining the incremental lengths of said drill string moved into said borehole from said platform while said drill bit is drilling into said earth formations for deriving a first signal proportional to successive increases in the overall length of said drill string in relation to said platform;

successively determining the incremental changes in the overall length of said drill string due to variations in tensional forces acting thereon for alternatively deriving either a second signal or a third signal respectively proportional to successive elongational increases or contractional decreases in said overall drill string length;

successively determining the positional changes of said platform in relation to the earth for alternatively deriving either a fourth signal or a fifth signal respectively representative of incremental upward and downward movements of said platform; and alternatively combining said first, second and fifth signals with one another for deriving an output signal representative of overall increases in said overall drill string length upon further advancement of said drill bit into said earth formations and combining said first, second and fifth signals with said third and fourth signals upon each occurrence of either said third signals or said fourth signals for selectively discontinuing further transmission of said output signal and then algebraically summing said combined signals only so long as the summation of further length increases respectively represented by subsequently occurring first, second and fifth signals is less than the summation of further length decreases represented by subsequently-occurring third and fourth signals.

2. The method of claim 1 wherein said incremental length changes are determined by measuring incremental changes in tensional forces imposed on said drill string, and multiplying said incremental force changes by a coefficient representative of the rate of elongation and said overall drill string length.

3. The method of claim 1 further including the step of:

averaging said output signal over a selected time interval for determining the actual rate of penetration of said drill bit during said selected time interval.

4. The method of claim 1 further including the step of:

totalizing said output signal over a selected time interval for determining the total downward advancement of said drill bit in relation to the earth during said selected time interval.

5. A method for determining at least one function representative of the penetration into earth formations by a drill bit suspended from a drill string carried by a floating platform and disposed in a borehole, comprising the steps of:

successively determining the incremental lengths of said drill string moved into said borehole from said platform while said drill bit is drilling into said earth formations for deriving a first signal proportional to successive increases in the overall length of said drill string in relation to said platform;

successively determining the incremental changes in the overall length of said drill string due to variations in tensional forces acting thereon for alternatively deriving either a second signal or a third signal respectively proportional to successive elongational increases or contractional decreases in said overall drill string length;

successively determining the positional changes of said platform in relation to the earth for alternatively deriving either a fourth signal or a fifth signal respectively representative of incremental upward and downward movements of said platform;

successively determining the positional changes of the upper end of said drill string in relation to said platform caused by operation of a heave compensator supporting said drill string for alternatively deriving either a sixth signal or a seventh signal respectively representative of incremental upward or downward movements of said upper end of said drill string caused by said heave compensator; and alternatively combining said first, second fifth and seventh signals with one another for deriving an output signal representative of overall increases in said overall drill string length upon further advancement of said drill bit into said earth formations and combining said first, second, fifth and seventh signals upon each occurrence of said third, fourth and sixth signals for selectively discontinuing further transmission of said output signal and then algebraically summing said combined signals only so long as the summation of further length increases respectively represented by subsequently occurring first, second, fifth or seventh signals is less than the summation of further length decreases represented by subsequently-occurring third, fourth or sixth signals.

6. The method of claim 5 wherein said incremental length changes are determined by measuring incremental changes in tensional forces imposed on said drill string, and multiplying said incremental force changes by a coefficient representative of the rate of elongation and said overall drill string length.

7. The method of claim 5 further including the step of:

averaging said output signal over a selected time interval for determining the actual rate of penetration of said drill bit during said selected time interval.

8. The method of claim 5 further including the step of:

totalizing said output signal over a selected time interval for determining the total downward advancement of said drill bit in relation to the earth during said selected time interval.

9. A method for determining the rate of penetration into earth formations by a drill bit suspended from a drill string carried by a floating platform and disposed in a borehole, comprising the steps of:

successively determining the incremental lengths of said drill string moved into and out of said borehole from said platform during a selected time interval while said drill bit is drilling into said earth formations for alternatively deriving either a first signal or a second signal respectively proportional to successive increases or decreases in the overall length of said drill string with respect to said platform during said selected time interval;

successively determining the incremental changes in the overall length of said drill string due to variations in tensional forces acting thereon during said selected time interval for alternatively deriving either a third signal or a fourth signal respectively proportional to successive elongational increases or contractional decreases in the overall length of said drill string in said borehole during said selected time interval;

successively determining the incremental changes in the position of said platform with respect to a fixed datum for alternatively deriving either a fifth signal or a sixth signal respectively proportional to successive movements of said platform toward or away from said fixed datum during said selected time interval;

alternatively combining said first, third and fifth signals with one another for deriving an output signal representative of overall increases in the length of said drill string upon further advancement of said drill bit into said earth formations during said selected time interval and combining said first, third and fifth signals with said second, fourth and sixth signals upon each occurrence of either of said second, fourth or sixth signals for selectively discontinuing transmission of said output signal and then algebraically summing said combined signals only so long as the summation of further length increases respectively represented by subsequently-occurring first, third or fifth signals is less than the summation of further length decreases represented by subsequently-occurring second, fourth or sixth signals; and averaging said output signal over said selected time interval for determining the actual rate of penetration of said drill bit in relation to said fixed datum during said selected time interval.

10. The method of claim 9 wherein said fixed datum is the surface of the earth.

11. The method of claim 9 further including the step of:

totalizing said output signal over said selected time interval for determining the total downward advancement of said drill bit in relation to said fixed datum during said selected time interval.

12. The method of claim 11 wherein said fixed datum is the surface of the earth.

13. The method of claim 9 wherein said drill string is coupled to said platform by way of a heave compensator adapted to expand and contract for moving the upper end of said drill string independently of the movements of said platform and further including the steps of:

successively determining the incremental changes in the position of said upper end of said drill string with relation to said platform due to movement of said heave compensator during said selected time interval for alternatively deriving either a seventh signal or an eighth signal respectively proportional to successive expansions or contractions of said heave compensator; and alternatively combining said seventh and eighth signals with said output signal and said combined signals respectively for correspondingly modifying said output signal and said combined signals to produce a more-accurate determination of said actual rate of penetration upon averaging of said modified output signal.

14. The method of claim 13 further including the step of:

totalizing said output pulses for providing an indication of the actual depth of said drill bit in said borehole.

15. Apparatus adapted for determining the rate of penetration into earth formations by a drill bit suspended from a drill string carried by a floating platform and disposed in a borehole penetrating such formations and comprising:

first displacement-responsive means adapted for producing a series of first electrical pulses respectively corresponding to a downward movement in relation to such a platform of an incremental length of a drill string into a borehole during a drilling operation from such a platform;

elongation-responsive means adapted for alternatively producing either a series of second electrical pulses or a series of third electrical pulses respectively corresponding to incremental elongational and contractional changes in the overall length of a drill string in a borehole during a drilling operation from such a platform;

second displacement-responsive means adapted for alternatively producing either a series of fourth electrical pulses or a series of fifth electrical pulses respectively corresponding to incremental upward and downward movements of such a platform during a drilling operation therefrom;

processing means operatively coupled to said displacement-responsive means and to said elongation-responsive means and adapted to respond to said electrical pulses produced thereby for providing a series of electrical output pulses respectively corresponding to a net incremental increase in the overall length of a drill string in relation to the surface of the earth during a drilling operation so long as the total number of said first, second and fifth electrical pulses produced during a selected time interval exceeds the total number of said third and fourth electrical pulses produced during said selected time interval; and converting means operatively coupled to said processing means and adapted to respond to said output pulses for providing an output signal representative of the actual rate of penetration into earth formations by a drill bit while drilling a borehole from such a platform during said selected time interval.

16. The apparatus of claim 15 wherein said processing means provides said output pulses by directing said first, second and fifth electrical pulses to said converting means whenever the total number of said first, second and fifth electrical pulses produced during said selected time interval exceeds the total number of said third and fourth electrical pulses produced during said selected time interval.

17. The apparatus of claim 15 further including:

totalizing means operatively coupled to said processing means and adapted to respond to said output pulses for providing a signal representative of the actual depth of such a drill bit in a borehole during said selected time interval.

18. The apparatus of claim 15 wherein said processing means include:

reversible pulse-counting means having an addition input, a subtraction input, and an output and operatively arranged for alternatively providing a first gate-control signal at said output whenever no pulses are received by one of said inputs and providing a second gate-control signal at said output so long as the number of pulses received by said one input exceeds the number of pulses received by the other of said inputs, means adapted for coupling said third and fourth electrical pulses to said one pulse-counting means input, and gating means adapted to receive said first, second and fifth electrical pulses and having a first output for directing said first, second and fifth electrical pulses as said output pulses to said converting means in response to said first gate-control signal and a second output for directing said first, second and fifth electrical pulses to said other pulse-counting means input in response to said second gate-control signal.

19. The apparatus of claim 15 wherein said processing means include:

reversible pulse-counting means having an addition input, a subtraction input, and an output and operatively arranged for alternatively providing a first gate-control signal at said output for a predetermined state of said pulse-counting means and providing a second gate-control signal at said output for another predetermined state of said pulse-counting means, means adapted for coupling said third and fourth electrical pulses to one of said inputs of said pulse-counting means, and gating means adapted to receive said first, second and fifth electrical pulses and having a first output for directing said first, second and fifth electrical pulses as said output pulses to said converting means in response to said first gate-control signal and second output for directing said first, second and fifth electrical pulses to the other of said inputs of said pulse-counting means in response to said second gate-control signal.

20. The apparatus of claim 15 wherein said converting means include circuit means adapted for determining the frequency of said output pulses during said selected time interval to provide said output signal.

21. The apparatus of claim 15 wherein said first displacement-responsive means are further adapted for alternatively producing a series of sixth electrical pulses respectively corresponding to an incremental decrease in the overall length of a drill string in a borehole during a drilling operation; and said processing means are adapted for providing said output pulses so long as the total number of said first, second and fifth electrical pulses produced during said selected time interval exceeds the total number of said third, fourth and sixth electrical pulses produced during said selected time interval.

22. The apparatus of claim 15 wherein said elongation-responsive means include:

tension-responsive means adapted to be coupled to a drill string and responsive to tension variations therein for producing electrical signals representative of increases and decreases of the overall length of such a drill string; and signal-differentiating means coupled to said tension-responsive means and adapted to receive said electrical signals as well as first and second comparison signals of selected equal magnitude for alternatively producing said second electrical pulses only so long as the magnitude of said electrical signals is greater than the magnitude of said first comparison signal and producing said third electrical pulses only so long as the magnitude of said electrical signals is less than the magnitude of said second comparison signal.

* * * * *